United States Patent [19]

McKinley et al.

[11] Patent Number: 4,462,495

[45] Date of Patent: Jul. 31, 1984

[54] PROCESS AND APPARATUS FOR THE SEPARATION OF PARTICLES INTO THREE FRACTIONS OF SIMILAR COMPOSITIONS

[75] Inventors: John R. McKinley, Claremont; John G. Roeschlaub, Upland, both of Calif.

[73] Assignee: Occidental Research Corporation, Irvine, Calif.

[21] Appl. No.: 45,185

[22] Filed: Jun. 4, 1979

[51] Int. Cl.[3] ..... B07C 5/02

[52] U.S. Cl. ..... 209/3.3; 209/576

[58] Field of Search ..... 209/3, 4, 9, 3.1, 3.2, 209/639, 638, 3.3, 576–582, 587, 589

[56] References Cited

U.S. PATENT DOCUMENTS

| | | | |
|---|---|---|---|
| 3,346,111 | 10/1967 | Thompson et al. | 209/9 |
| 3,356,211 | 12/1967 | Mathews | 209/639 |
| 3,412,375 | 10/1969 | Mathews | 209/3.1 |
| 3,795,310 | 3/1974 | Buchot | 209/3.3 |
| 3,901,793 | 8/1975 | Buchot | 209/1 |
| 3,936,188 | 2/1976 | Sawyer | 209/3.1 |

*Primary Examiner*—Robert B. Reeves
*Assistant Examiner*—Donald Hajec
*Attorney, Agent, or Firm*—Christie, Parker & Hale

[57] ABSTRACT

A process is disclosed for the separation of a mixture of particles containing differing concentrations of a selected component into three fractions of similar concentration of the selected component. The process comprises conditioning the mixture of particles with a hydrophobic or hydrophilic surface-active agent to selectively coat each of the particles relative to the concentration of the selected component in each particle. In combination with the surface-active agent there is provided a fluorescent dye which either adheres to the coated or non-coated particles. The mixture of conditioned particles is then irradiated to excite and induce fluorescence of the fluorescent dye to a degree sufficient to distinguish among the intensities of fluorescence of the fluorescent dye on the various particles. The particles are separated into concentrate, middling and tailing fractions based upon distinguishing among the intensities of fluorescence.

4 Claims, 2 Drawing Figures

PROCESS AND APPARATUS FOR THE SEPARATION OF PARTICLES INTO THREE FRACTIONS OF SIMILAR COMPOSITIONS

BACKGROUND OF THE INVENTION

The present invention relates to a process for separating particles into three fractions of similar composition. The invention also relates to apparatus for conducting the process.

In particular, the process herein relates to the separation of an ore into three fractions consisting of a concentrate, middling and tailing. More particularly, the process relates to separating an ore into three fractions by utilizing the surface chemical properties of the ore particles to distinguish among the ore particles.

The process and apparatus have utility in the categorizing of mineral ores, such as limestone, quartz, magnesite, chalcopyrite, chalcocite, galena, sphalerite and the like, and other ore-like particles such as coal, oil shale and the like. For convenience, coal and oil shale are encompassed within the broad definition of ore as used herein.

Current methods of optically sorting a component from an ore in which it is contained utilize the natural or induced differences in color or reflectivity of the various components which constitute an ore. Using such differences in coloration or reflectivity, the components of an ore can be separated by hand or mechanical optical sorting techniques. However, some problems are presented with current optical sorting techniques.

One problem encountered in separating the components of an ore is the occurrence of a range of colors or reflectivity for a valuable component within the ore. Such a range of colors or reflectivity for the valuable component can overlap a range of colors or reflectivity exhibited by a nonvaluable component in the ore, e.g., both limestone and quartz can have essentially the same color and reflectivity. Therefore, during the separation and sorting of the components of an ore some of the nonvaluable ore components are sorted along with the valuable ore components and some of the valuable ore components are discarded with the gangue. Further, when there is an overlap of the range of color and reflectivity for the valuable and nonvaluable components, there is a sacrifice of percent yield when purity of the valuable component is desired and correspondingly there is a sacrifice of percent purity when a high yield of valuable component is desired.

A disadvantage of optically sorting components of an ore by the naturally occurring color and reflectivity of the individual components is that such a sorting method is limited to use on only those ores wherein the individual components exhibit a color or reflectivity capable of being differentiated.

Separating ore components by their naturally occurring differences in color or reflectivity is conducted by hand sorting or by machine which senses color or reflectivity. Hand sorting is limited to the ability of the individual to discern optical differences in color and/or reflectivity. Hand sorting is typically a job for unskilled labor. Due to this level of skill of the laborer and the tediousness of the job, there is generally a high turnover rate for workers involved in such hand-sorting operations. Unfortunately, the ability to separate the components of an ore by hand-sorting techniques in order to obtain products of value, is acquired either after extensive training or by experience in conducting such hand-sorting.

SUMMARY OF THE INVENTION

In accordance with this invention there is disclosed a process for the separation of a mixture of particles of differing concentrations of a selected component into concentrate, middling and tailing fractions, with each fraction comprising particles of similar concentration of the selected component. The mixture of particles is conditioned with at least one surface-active agent selected from compounds that are capable of providing hydrophobic coatings or hydrophilic coatings and which chemically react with the selected component to the substantial exclusion of reacting with the nonselected components in the particles. The surface-active agent selectively provides a coating on those particles containing the selected component in an amount based upon the concentration of selected component in each particle.

In combination with conditioning the particles with the selective agent, there is provided as a marking agent a fluorescent dye selected from hydrophobic and hydrophilic fluorescent dyes. By selecting between a hydrophobic or hydrophilic surface-active agent and a hydrophobic and a hydrophilic fluorescent dye, different combinations of the dye and surface-active agent are possible such that the dye can couple with the surface-active agent or can coat those particles substantially non-coated by the surface-active agent.

The particles, after conditioning with the surface-active agent and fluorescent dye, are irradiated to excite and induce fluorescence of the dye to a degree sufficient to distinguish among the particles by the fluorescence. The fluorescence of each particle is detected and the mixture of particles is separated into three fractions with each fraction containing particles of similar fluorescence. Each of the three fractions of similar fluorescence contain particles of similar concentration thus providing a concentrate, middling and tailing with respect to the selected component.

To separate and sort the conditioned particles, the particles are passed in free-fall through an irradiation zone wherein the particles are irradiated to induce fluorescence of the fluorescent dye on the particles.

A fluorescence detector is positioned along the free-fall path of the particles. The detector monitors the fluorescence of each particle while the particle is in the irradiation zone, or subsequently thereafter, and as the particle is in free-fall. The detector sends a signal of the intensity of fluorescence to a control unit which controls two separate deflectors positioned to deflect a falling particle in a divergent path from the initial free-fall path. The two deflectors are also positioned to deflect a particle in separate paths from each other. As the detector monitors the fluorescence of each particle it signals the intensity of the fluorescence to the control unit which activates one of the deflectors or allows the particle to continue to fall in an undeflected path. Generally, one deflector directs particles into a concentrate collector, the other deflector directs particles into a middling collector and those particles falling without deflection are collected in a tailing collector.

Rather than selecting a surface-active agent which reacts with the selected component in the particles, a surface-active agent can be selected which exhibits substantially no affinity for the selected component but rather reacts with at least one of the other components present in the particles. In using such a surface-active agent, those particles containing a relatively low selected component content are coated with the selective surface-active agent to the substantial exclusion of coating those particles having a relatively high selected component content. Such a surface-active agent can exhibit either hydrophobic or hydrophilic coating capabilities. A fluorescent dye selected from hydrophobic or hydrophilic fluorescent dyes is provided which, depending upon the combination of surface-active agent and dye, either combines with the coating of surface-active agent or provides a coating itself to those particles substantially not coated and relatively lesser coated by the surface-active agent. When the surface-active agent and fluorescent dye are of unmatched hydrophobic/hydrophilic character then the particles exhibiting the relatively higher intensity of fluorescence comprise the particles of lower concentration of selected component, i.e., the tailing fraction; the particles exhibiting a relatively lower intensity of fluorescence comprise particles of higher concentration of selected component, i.e., middling fraction; and the particles exhibiting substantially no or relatively little fluorescence comprise particles of greatest concentration of selected component, i.e., the concentrate fraction.

Apparatus for conducting the process of separating the mixture of particles into three fractions is also disclosed. The apparatus comprises means for conditioning the mixture of particles with a surface-active agent and fluorescent dye. The apparatus also comprises means for delivering the conditioned particles in free-fall to an irradiation zone. In the irradiation zone the particles are irradiated by an irradiation source with sufficient electromagnetic radiation to excite and induce fluorescence of the fluorescent dye. A means for fluorescence detection is positioned along the free-fall path of the particles to enable detection of the induced fluorescence of the dye. The detector signals a control unit which controls two deflectors positioned below the detector and along the free-fall path of the particles. The two deflectors are activated independently of each other and are positioned such that each deflector can divert a falling particle in a different direction. Utilizing the two deflectors there is provided three paths through which a particle can fall, the initial free-fall path, the path after deflection by the first deflector and the path after deflection by the second deflector.

BRIEF DESCRIPTION OF THE DRAWINGS

These and other aspects of this invention will be more fully understood by reference to the following detailed description and accompanying drawings wherein.

DETAILED DESCRIPTION OF THE INVENTION

Figure 1:
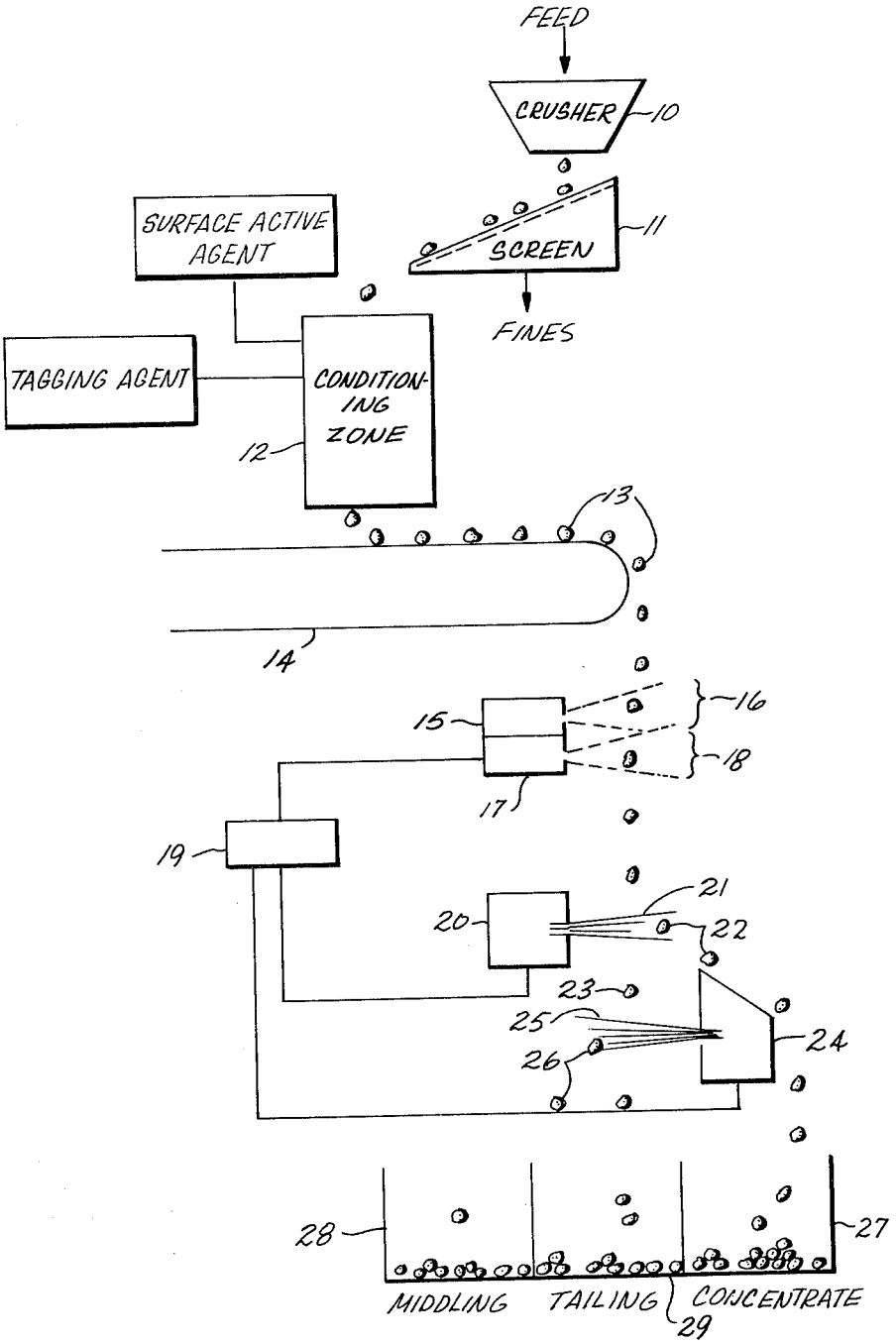
FIG. 1 schematically illustrates an embodiment of apparatus for carrying out the process herein disclosed.

The process herein provides the separation of a mixture of particles into three fractions with each fraction containing particles of similar concentration with regard to a selected component of the particles. The process is based upon the differences in the surface chemical properties of the various components present in the particles to be separated. For example, when the particles to be separated are an ore, the ore is comprised of various components of differing surface chemical properties. As used herein, the word "ore" will be used in a generic sense to refer to particles containing a substance or component of value, which particles include particles within the general definition of ore, such as limestone, quartz, magnesite, chalcopyrite, chalcocite, galena, sphalerite and the like, and also include particles such as oil shale, coal and the like.

The process herein provides a separation of a particulate ore into a higher-grade fraction (concentrate), a lower-grade fraction (middling) and a gangue fraction (tailing) with regard to a specific component of choice in the ore. By the terms "higher-grade" and "lower-grade" is meant a relative distinction with regard to the concentration of a specific component between the two grades of ore. Such a relative distinction can be variable depending upon the reasoning for distinguishing between the grades, such as grading the ore in consonance with the numerous end uses to which the ore can be used. The higher-grade and lower-grade fractions in which an ore can be classified by a process herein are referred to as concentrate and middling fractions.

Due to surface chemical properties, there can be selected a surface-active agent or a mixture of surface-active agents that can effectively, selectively coat certain components present in an ore and in an ore particle. A separation based upon surface chemical properties provides relatively consistent separation results which generally tend to be more consistent than separation methods based upon other properties, such as color, reflectance and conductivity. These other properties generally tend to be substantially similar for the various components of an ore, such that a fine degree of resolution is required in order to distinguish among these properties for ore particles. A fine degree of resolution can be difficult to obtain when conventional separating techniques are utilized. Therefore, the efficiency of separation based upon these other properties suffers.

A surface-active agent is selected that selectively reacts with a preselected component (hereinafter sometimes referred to as component of choice) within the ore particles because of the surface chemical properties of the selected component.

The selection of a surface-active agent is made from compounds that can react with components in the particles to be separated such that the surface-active agent bonds or closely associates with a component in a particle to form a coating of the surface-active agent on the particle. Surface-active agents are also selected from compounds that provide hydrophobic or hydrophilic coatings upon conditioning of the particles with the surface-active agent. After conditioning of the particles with a surface-active agent and after reaction of the surface-active agent with the selected component in the particles for which the surface-active agent is reactive, a hydrophobic or hydrophilic coating is provided on those particles containing the selected component in an amount dependent upon the concentration of the selected component in the particle. The election of whether to select a hydrophobic or hydrophilic surface-active agent is dependent upon the nature of the particles in the mixture which are not substantially coated with the surface-active agent.

To distinguish among the surface-active-agent-coated particles the amount of coating on such particles and the non-coated particles, the particles can be conditioned with a marking agent, such as a fluorescent dye.

The fluorescent dye is selected from hydrophobic and hydrophilic fluorescent dyes. When the particles are coated with a hydrophobic coating, then the selection of a hydrophobic fluorescent dye provides the coupling of the dye with the surface-active agent coating. The same is true when a hydrophilic coating is provided and a hydrophilic fluorescent dye is selected. When the particles are coated with a hydrophobic coating, the selection of a hydrophilic fluorescent dye provides a coating of the dye on the particles substantially non-coated with the surface-active agent and to a relative lesser extent, a fluorescent dye coating on the relatively lesser surface-active-agent-coated particles. The same holds true for the selection of a hydrophilic surface-active agent and hydrophobic fluorescent dye. In this manner, the fluorescent dye can be selectively coupled with either the surface-active agent coating on the particles or the non-coated areas of the particles.

The particles that are coated are coated in varying amounts with the surface-active agent because of the availability of the selected component in each particle to react with the surface-active agent. Similarly, the fluorescent dye combines with the coated, partially coated, or substantially non-coated particles in varying concentration to provide different intensities of fluorescence upon excitation among the particles. Such varying intensities of fluorescence provide, upon monitoring, an arbitrary method of distinguishing and characterizing the particles into three fractions. A first fraction can comprise those particles that fluoresce at a relatively high intensity, a second fraction can comprise those particles that fluoresce at a relatively lower intensity and a third fraction can comprise those particles that exhibit substantially little fluorescence. The particles are thereby separated into the three fractions based upon the amount of fluorescent dye and surface-active agent on each individual particle. For example, when the marking agent is a hydrophobic fluorescent dye and the particles are conditioned with surface-active agent providing a hydrophobic coating, the dye is combined with the surface-active agent coating. The dye combined with the surface-active agent coating fluoresces upon excitation with actinic radiation and the substantially non-coated particles containing substantially no fluorescent dye do not fluoresce to any substantial degree.

The intensity of fluorescence of the dye depends upon the concentration of the dye on the particle. The concentration of the fluorescent dye on a particle depends upon the concentration of surface-active agent coating a particle. If the surface-active agent and fluorescent dye are both hydrophobic or both hydrophilic, then the concentration of fluorescent dye is directly related to the amount of surface-active agent which provides the coating on a particle. The amount of surface-active agent providing the coating is directly related to the concentration and availability of the selected component in the particle. Particles with a relatively high concentration of selected component have a relatively high amount of surface-active agent corresponding to a relatively high concentration of fluorescent dye. Particles with less selected component have less surface-active agent and less fluorescent dye. Particles containing substantially no selected component essentially have no appreciable coating nor fluorescent dye. If the surface-active agent is hydrophobic and the fluorescent dye is hydrophilic (or vice versa), then a particle that has a relatively high selected component content and a relatively high amount of surface-active agent in a coating, has a relatively low fluorescent dye concentration. Correspondingly, particles with a lesser coating of surface-active agent have a greater amount of fluorescent dye. The fluorescence and intensity of fluorescence thereby provide a mechanism for differentiating among the particles to be separated based upon the content of the selected component in the particles.

Generally, fluorescence refers to the property of absorbing radiation at one particular wavelength and simultaneously reemitting light of a different wavelength as long as the stimulus is active. It is intended in the present process to use the term fluorescence to indicate the property of absorbing radiation at one particular wavelength and reemitting it at a different wavelength, whether or not visible, during exposure to an active stimulus or after exposure or during both these time periods. Thus, fluorescence is used generically herein to include fluorescence, phosphorescence and envisions emission of electromagnetic waves whether or not within the visible spectrum.

Electromagnetic radiation generally refers to the emission of energy waves of all the various wavelengths encompassed by the entire electromagnetic spectrum. It is intended in the present process and discussion to use the term electromagnetic radiation to indicate any and all stimuli that excite and induce fluorescence of a fluorescent dye. Thus, electromagnetic radiation is used generically herein to include electromagnetic radiation and envisions other stimuli that excite and induce fluorescence of a fluorescent dye.

In practicing the present process with regard to a mixture of ore particles, the ore is first subjected to a crushing step. In this crushing step, the ore is crushed to physically separate a selected component of the ore from the gangue present in the ore. Crushing increases the surface area of the particles providing a greater surface and reactive site for the conditioning and coating of the particles by the surface-active agent. The ore is crushed typically to a particle size of from about $\frac{1}{4}$ inch to about 8 inches. Particle sizes of less than $\frac{1}{4}$ inch can be used in the practice of this process, however, such sizes require greater amounts of surface-active agent and are more difficult to separate as they require greater amounts of time for separation for a given mass of ore. Particle sizes of greater than 8 inches can be used in the practice of this process but generally such particle sizes entrain such a substantial mixture of components that separation efficiency decreases. It is preferred to use particles of a size from about $\frac{1}{2}$ inch to about 3 inches.

Following the crushing and sizing steps, the ore particles can be deslimed to remove soluble impurities and surface fines which can be present on the ore particles.

The process is practiced by conditioning a mixture of particles following sizing with a surface-active agent or mixture of surface-active agents that selectively adheres to a preselected component present in the particles. The preselected component can be a component of value that is desirable to be sorted from the mixture of particles. Alternatively, the selected component can be a substantially nonvaluable component, such as the gangue present in the mixture of particles. Preferably, it is desirable to select a surface-active agent that exhibits an affinity toward the valuable component present in an ore. In this manner, the particles containing valuable selected component are coated with at least some of the surface-active agent. Even those particles containing only a small concentration of the selected component are coated to a small extent, thereby enabling some differentiation between coated and non-coated particles. For example, when limestone is to be sorted from a limestone ore, it is preferable to select a surface-active agent that is selective for the limestone or calcium carbonate component.

The surface-active agent is used in sufficient quantity to provide a thin film coating on the components of the ore toward which the surface-active agent is reactive or exhibits an affinity. Due to the surface chemical properties of the components, the surface-active agent reacts with the preselected components within the ore toward which it has an affinity to the substantial exclusion of reacting with other components within the ore.

An ore is conditioned with the surface-active agent by mixing the surface-active agent in a surface reactive relationship with the particulate and sized ore. Conditioning of an ore with the surface-active agent is accomplished by contacting the ore particles with the surface-active agent. The surface-active agent can be used in any suitable manner, such as in solution, suspension, dispersion, or by itself. It is preferred to form a dispersion of the surface-active agent in water. Such a dispersion can be readily coated on the particles and water is an economical and readily available dispersant. Many techniques are available for contacting solid particles with a liquid reagent. Such techniques include dipping the particles into a liquid bath containing the surface-active agent, spraying the surface-active agent onto the solid particles, mixing the solid particles with the surface-active agent and the like. In the preferred process of using an aqueous dispersion of surface-active agent, the particles are passed through an aqueous dispersion bath to condition the particles with the surface-active agent. Alternatively, the particles can be sprayed with the aqueous surface-active agent dispersion. As the surface-active agent contacts the particles, those particles having the proper surface-chemical properties are receptive to the surface-active agent. Following the contacting of the particles with the surface-active agent, the particles can be washed with an aqueous wash to remove excess surface-active agent and any surface-active agent entrained within the particles.

Either simultaneously with or following the conditioning of the mixture of particles with the surface-active agent, the particles are also conditioned with the fluorescent dye marking agent. The fluorescent dye can be a liquid or solid dye or a liquid or solid pigmenting material which provides a fluorescent dye on coupling with the surface-active agent. It is preferred to use a solid fluorescent dye in a suitable dispersion to minimize extraneous coating of the particles that are nonreceptive to the surface-active agent. It is also preferred to use a fluorescent dye that is water insoluble as a water soluble fluorescent dye can dissolve in any water present during the conditioning of the particles and impart the characteristic fluorescence of the dye to components which are not coated with the surface-active agent along with those particles which are coated with the surface-active agent. For example, some of the particles can have a coating of water formed upon their surface. This aqueous coating of the particles can absorb some of the fluorescent dye if the fluorescent dye is water soluble, thereby imparting the characteristic properties of the fluorescent dye to the water-coated particles. It is then difficult to distinguish between the water-coated particles and the surface-active-agent-coated particles. Use of a water insoluble fluorescent dye that has an affinity toward the surface-active agent substantially inhibits the formation of any appreciable coating by the fluorescent dye on particles which are not coated with the surface-active agent.

The above discussion relates to combining the fluorescent dye with the surface-active agent coating on the particles within a mixture of particles. There can also be used a fluorescent dye which exhibits repulsion from the surface-active agent. A fluorescent dye which is selected that is unreactive toward the surface-active agent can coat those particles in the ore which have a low concentration of the selected component toward which the surface-active agent is selectively reactive and can partially coat those particles partially coated with the surface-active agent. Thus, there is provided with the process the ability of coating those particles containing a selected component and coupling with that coating a fluorescent dye, or marking those particles substantially non-coated, or lesser coated, with the selective surface-active agent. With either alternative of the process, a separation of the particles can be effected.

The fluorescent dye can be provided in any suitable form such as in solution, dispersion, suspension or by itself. It is preferred to use the fluorescent dye dispersed in a suitable dispersant. The particles conditioned with the surface-active agent can be contacted with the fluorescent dye by any suitable means such as by dipping the particles into a dispersion bath containing the dye, spraying the dye onto the particles, intermixing the dye with the conditioned particles and the like. Any excess fluorescent dye, and that physically entrained in the particles, can be washed from the particles and recycled for use in another separation.

The fluorescent dye can be provided to the selective surface-active agent either prior or subsequent to the conditioning of a mixture of particles with the surface-active agent. It is preferred to combine the surface-active agent and fluorescent dye prior to conditioning of the particles. Then, as the particles are conditioned with the selective surface-active agent, those particles reactive with the surface-active agent are simultaneously provided with the fluorescent dye. Combining the surface-active agent and fluorescent dye prior to conditioning uses less fluorescent dye, requires fewer steps and is generally more efficient both economically and in separation results.

Many methods of contacting the particles with the surface-active agent are available and the techniques of such methods are known to those skilled in the art. Such methods include the spraying of the surface-active agent onto the sized particles, the passing of particles through a dispersion bath and the like. It is preferred to spray the sized particles with an aqueous dispersion of the surface-active agent as hereinbefore discussed. Spraying techniques include, but are not limited to, spraying the surface-active agent onto the particles as the particles pass a spraying nozzle on a vibrating screen or belt, or spraying the particles as they pass in free-fall through a ring sprayer or series of ring sprayers. A method for spraying particles is shown in United States patent application Ser. No. 897,946, filed on Apr. 19, 1978, by Brij M. Moudgil and John G. Roeschlaub, entitled METHOD AND APPARATUS FOR SELECTIVE WETTING OR PARTICLES now abandoned, the entire disclosure of which is incorporated herein by this reference.

Following the conditioning of the mixture of particles with the surface-active agent and the coupling of the fluorescent dye with the particles, the particles can be rinsed with a suitable washing agent, such as water, to remove excess surface-active agent and fluorescent dye from the particles and any surface-active agent or fluorescent dye that is physically entrained in the particles. The surface-active agent selectively remains coated on those particles for which it has a preference due to the surface-chemical properties of those particles.

The conditioned particles, after being conditioned with the surface-active agent and fluorescent dye, are exposed to electromagnetic radiation of sufficient energy to induce and excite the fluorescent dye to a degree sufficient to cause the dye to fluoresce. Based upon the intensity of fluorescence exhibited by each particle, the particles can be separated into three fractions consisting of a concentrate, middling and tailing fraction. For example, if a selective surface-active agent was selected which has an affinity toward a selected component present in an ore and there is coupled with the surface-active agent a fluorescent dye having an affinity toward the surface-active agent, a concentrate fraction can be separated from a mixture of ore particles which concentrate fraction comprises those particles having a certain intensity of fluorescence. Those particles having a lesser intensity of fluorescence than the particles arbitrarily assigned to the concentrate fraction comprise the middling fraction. Those particles exhibiting substantially no fluorescence or a relatively low intensity of fluorescence comprise the tailing fraction.

The accompanying drawings represent apparatus for effecting separation of a mixture of particles into three fractions. In the drawings like elements are referred to with the same numbers. The process can also be illustrated by reference to the drawings. With reference to FIG. 1, a feed material consisting of particles to be separated, such as a raw ore, is fed to a crusher 10. In the crusher the feed material is crushed to provide a particle size from about ¼ of an inch to about 8 inches. From the crusher 10 the particles are transferred to a screen 11. The screen 11 sizes the particles to provide particles of a size at least greater than ¼ inch. The fines from the screen can be discarded or can be treated in a different process to recover possible values therein.

After the particles have been sized to the preferred size, they are transferred to a conditioning zone 12. In the conditioning zone 12 the sized particles are conditioned with a surface-active agent in combination with a fluorescent dye. The particles 13 leaving the conditioning zone 12 comprise a mixture of particles which are coated with a varying amount of the surface-active agent and particles which are substantially non-coated with the surface-active agent. The conditioned particles 13 are transferred to an irradiation zone 16 by conveying means such as conveyor 14 to enable the conditioned particles 13 to be irradiated for exciting and inducing fluorescence of the fluorescent dye. The conditioned particles 13 are conveyed off the end of conveyor 14 and fall in free-fall past an irradiation source 15 providing an irradiation zone 16. The irradiation source 15 provides sufficient electromagnetic radiation to excite and induce fluorescence of the dye coating on the particles. As the conditioned particles 13 fall through the irradiation zone 16 those particles having a fluorescent dye coating fluoresce at an intensity dependent upon the concentration of dye.

A detector 17 is positioned in proximity to the irradiation source 15. The detector 17 has a detection zone 18 through which the particles pass in free-fall. The detection zone 18 can overlap with the irradiation zone 16 in order for the detector 17 to be able to sense those particles that fluoresce only when simultaneously excited. The detector 17 has capabilities of differentiating among the varying intensities of fluorescence of the particles falling through the detection zone 18. The detector 17 monitors the intensity of fluorescence of each particle and transmits a signal characteristic of that intensity to a control unit 19. The control unit 19 contains electronic circuitry for gating, delaying logic and providing and controlling signal generation to two deflectors 20 and 24. The control unit 19 can be programmed to provide a signal which activates either a first deflector 20 or a second deflector 24 depending upon the intensity of fluorescence exhibited by a particle passing through the detection zone 18. The control unit 19 is programmed with delaying logic which provides the appropriate signal to either the first deflector 20 or the second deflector 24 at the appropriate time to deflect the particle which provided the signal from the detector 17 to the control unit while in the detection zone 18.

A first deflector 20 is positioned in proximity to the irradiation source 15 and the detector 17. The first deflector 20 is positioned such that the conditioned particles 13 fall through a first deflection zone provided by the deflector. The first deflection zone is provided by a fluid stream emitted from the first deflector 20. The fluid stream 21 is activated upon a signal provided by the control unit 19. For example, a conditioned particle 13 falls into the irradiation zone 16 and is irradiated to induce fluorescence. The fluorescence is detected in detection zone 18 by detector 17 which provides a signal of the intensity of the fluorescence to the control unit 19. The control unit 19 monitors the intensity and if the intensity is sufficiently high to indicate a relatively high concentration of the fluorescent dye on the particle then the control unit 19 sends a signal to the first deflector 20. The signal is timed such that it activates the first deflector 20 to emit a fluid stream 21 at the time the particle, which fluoresced and triggered the sequence, is within the first deflection zone. The particle is thereby struck by the emitted fluid stream 21. The fluid stream emitted by the deflectors herein can be a gas stream such as air or a liquid stream such as water. The deflected particle 22 falls in a deflected free-fall path different from the initial free-fall path of the particles. The deflected particles 22 deflected by the first deflector 20 fall and are collected as a first fraction of the mixture of particles. This first fraction, as shown in the drawing, can be a concentrate and can be collected in an appropriate collector 27.

If the particle detected by detector 17 exhibits fuorescence but at a lesser intensity than the intensity of the above-described particle, this level of intensity is communicated by the detector 17 to the control unit 19. The control unit 19 evaluates this lesser intensity and recognizes that the level of intensity is insufficient to provide a signal to the first deflector 20. However, the level of intensity can be sufficient for the control unit 19 to provide a signal to the second deflector 24. If the intensity of the fluorescence is below the threshold intensity required to trigger the first deflector 20, then the control unit 19 can trigger the second deflector 24 by sending a signal to the second deflector. The timing of the signal to the second deflector 24 is such that the second deflector 24 provides a fluid stream 25 at the same time the particle which fluoresced and triggered the sequence arrives within the second deflection zone of the second deflector 24. The particle 26 deflected by the second deflector 24 falls in a deflected free-fall path which differs from the original free-fall path of the conditioned particles and which differs from the deflected free-fall path of those particles deflected by the first deflector 20. The particles 26 can be collected in a suitable collector 28 and, as shown in the drawing, can comprise a middling fraction.

The conditioned particles 13 which are substantially non-coated by the fluorescent dye or which are coated with the fluorescent dye to only a small extent, fluoresce at a relatively low intensity or not at all. The fluorescence of these particles is detected by detector 17 and transmitted to the control unit 19. The control unit 19 is programmed such that an intensity of fluorescence below a certain threshold intensity does not provide a signal to either the first deflector 20 or the second deflector 24. A particle, therefore, having a sufficiently low intensity of fluorescence so as not to activate either deflector falls in a free-fall path that remains undeflected. A particle falling in such a non-deflected-free-fall path is collected in a collector 29 which in the drawing represents a tailing fraction.

Figure 2:
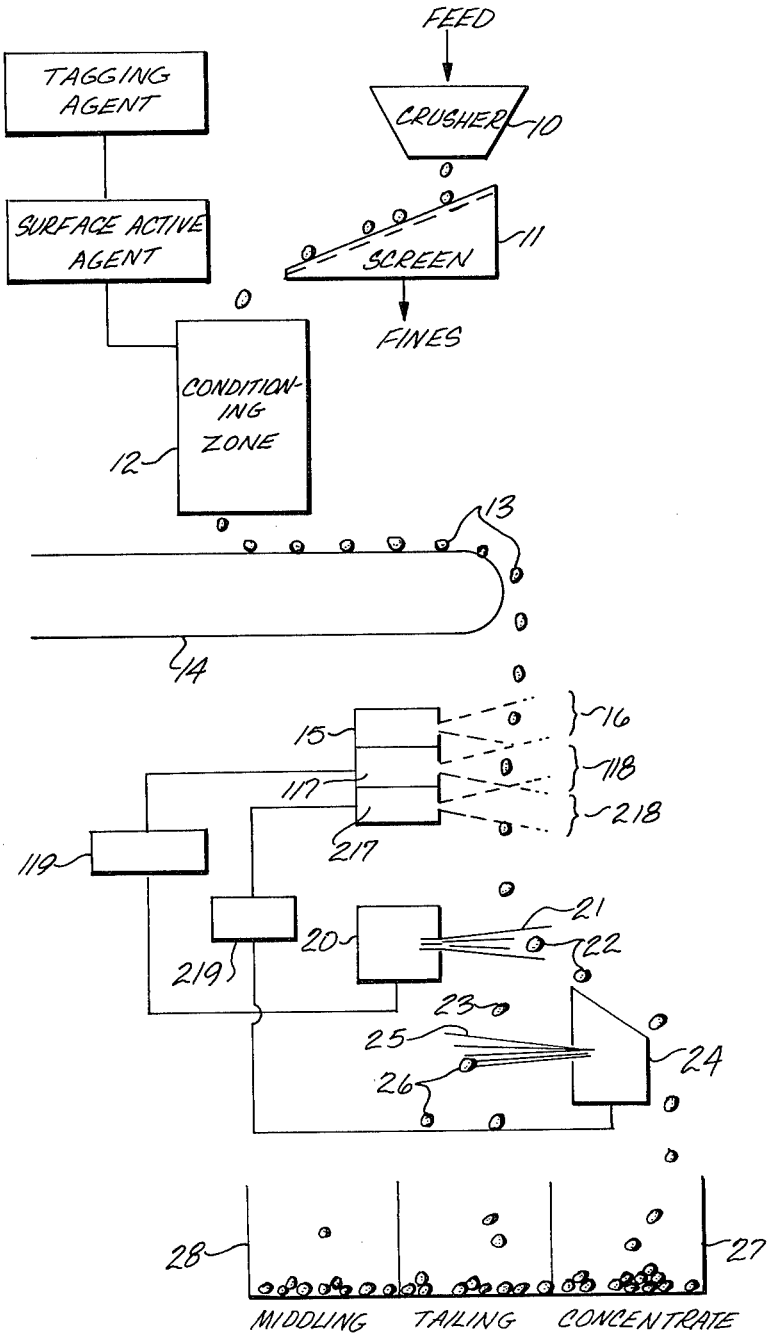
FIG. 2 schematically illustrates another embodiment of apparatus for carrying out the process herein disclosed.

With reference to FIG. 2 another embodiment of apparatus is illustrated. In the apparatus a crushed and sized particulate ore is conditioned with a surface-active agent and fluorescent dye tagging agent in the conditioning zone 12. The conditioned particles 13 containing coated, partially coated and substantially non-coated particles are conveyed by conveyor 14 such that the particles 13 fall in free-fall through an irradiation zone 16. The irradiation zone 16 is provided by a irradiation source 15. As the conditioned particles 13 fall through the irradiation zone, those particles having a fluorescent dye coating fluoresce at an intensity dependent upon the concentration of the dye.

A first detector 117 is positioned in proximity to the irradiation source 15. The first detector 117 provides a first detection zone 118 through which the particles fall. The first detection zone 118 can overlap with the irradiation zone 16 in order for the first detector 117 to be able to sense those particles that fluoresce only when simultaneously excited by actinic radiation. Such a first detector 117 can be provided with sensing means to monitor the intensity of fluorescence exhibited by particles within the detection zone 118. The intensity of fluorescence is transformed into a signal and transferred to a first control unit 119. The first control unit 119 contains electronic circuitry for gating, delaying logic and providing and controlling signal generation to a first deflector 20. The first control unit 119 can be programmed with a threshold fluorescence intensity such that a fluorescence intensity signal received from the first detector 117 does not activate the first control unit 119 to generate an activation signal to the first deflector 20 unless the fluorescence intensity signal received is greater than the programmed threshhold intensity. If the signal received is greater than the threshhold intensity, then the first control unit 119 provides a signal, which is delayed by the delay logic to the first deflector 20 to activate the deflector. Upon activation the first deflector 20 emits a fluid stream 21 which strikes the conditioned particle that activated the sequence, diverting the falling path of the particle into the collector 27.

A second detector 217 is positioned in proximity to the irradiation source 15 and the first detector 117. For ease of illustration the second detector 217 is shown at a level lower than the first detector 117. However, both detectors 117 and 217 can be located at the same elevation and/or at the same elevation as the irradiation source 15. For example, for particles that fluoresce only when simultaneously irradiated the three are preferably at the same elevation with overlapping irradiation and detection zones.

The second detector senses and monitors the intensity of fluorescence exhibited by a particle while falling through the second detection zone 218. The second detector provides a signal of such intensity to a second control unit 219. The second control unit 219 contains electronic circuitry for gating, delaying logic and providing and controlling signal generation to a second deflector 24. The second control unit 219 is programmed with a threshhold fluorescence intensity such that a signal received from the second detector 217 below the threshhold does not activate the second control unit to provide an activation signal to the second deflector 24. The second control unit 219 is also programmed with a ceiling fluorescence intensity level corresponding to the threshhold intensity level of first control unit 119. Any signal received by the second control unit 219 greater than such ceiling intensity level also does not activate the second control unit to generate an activating signal to the second deflector 24. If a fluorescence intensity signal is received by the second control unit of an intensity between the threshhold and ceiling levels, then the second control unit sends an activating signal to the second deflector 24. Upon activation the second deflector emits a fluid stream which stream 25 strikes the particle that activated the sequence and deflects the particle from its original free-fall path into collector 28.

The conditioned particles that exhibit a fluorescence of an intensity below the threshhold intensity to activate the second control unit and second deflector 24 continue to fall in free-fall and are collected in collector 29.

Although two separate control units 119 and 219 are shown in FIG. 2 and described above, one control unit capable of performing such functions can be utilized.

In a particular practice of the process with regard to limestone-bearing ore, calcium carbonate can be separated from quartz and silicates present in the ore. The limestone-bearing ore is first crushed to a particle size of greater than $\frac{1}{2}$ inch. Generally, the ore is crushed to a size range of from about $\frac{1}{2}$ to about 8 inches. Depending on whether the quartz or the limestone is to be coated with the surface-active agent, a surface-active agent is selected which adheres to either the limestone or quartz.

If the quartz is to be coated with the surface-active agent, a surface-active agent can be selected from aliphatic amines or a mixture thereof containing from about 8 to about 22 carbon atoms, and beta amines or mixtures thereof containing about 7 to about 21 carbon atoms. Aliphatic amines useful in the practice of the method of this invention include octyl amine, decyl amine, dodecyl amine, tetradecyl amine, hexadecyl amine, octyldecyl amine, eicosanyl amine, docosanyl amine and the like. Beta amines can include commercially available beta amines such as ARMEEN L-7 through L-15 series, which are registered trademark products of Armak Chemicals and are commonly known to those skilled in the art. Generally, amines containing more than about 22 carbon atoms are not as selective as amines containing less than about 22 carbon atoms. Aliphatic amines of less than about 8 carbon atoms and beta amines of less than about 7 carbon atoms generally do not have the desired coating properties. It is preferred to use an aliphatic amine containing about 10 to about 18 carbon atoms and a beta amine containing from about 7 to about 15 carbon atoms. The above-mentioned aliphatic and beta amines selectively coat the silicates present in limestone ore substantially to the exclusion of coating the calcium carbonate present in the limestone particles.

A water soluble amine surface-active agent selected from the water soluble salts of the above-identified aliphatic and beta amines can also be used to provide coatings on the silicates present in a mixture of limestone ore particles.

Surface-active agents that are useful in the practice of this process to coat the calcium carbonate present in limestone ore particles can be selected from saturated and unsaturated carboxylic acids including fatty acids which contain from about 5 to about 22 carbon atoms, or a mixture thereof. Carboxylic acids that can be used include palmitoleic acid, oleic acid, linoleic acid, caproic acid, caprylic acid, capric acid, lauric acid, myristic acid, palmitic acid, stearic acid, arachidic acid, behenic acid, tall oil fatty acids and the like. It is preferred to use at least one carboxylic acid containing from about 8 to about 18 carbon atoms. Carboxylic acids containing more than about 22 carbon atoms can be used, but generally tend to be less selective and thereby coat both the calcium carbonate and silicates present. Carboxylic acids of less than about 5 carbon atoms generally do not possess the ability to coat any of the particles to any substantial degree. In general, the preferred carboxylic acid enters a chemical reaction with the calcium carbonate, for example, oleic acid reacts to form calcium oleate.

Fluorescent dyes known to those skilled in the art, and which are compatible with the surface-active agents, can be used in the practice of the process herein in regard to limestone ore. It is preferred to use a water insoluble fluorescent dye when a water insoluble surface-active agent is used. Water soluble fluorescent dyes can dissolve in the water dispersant used to disperse the surface-active agent during the conditioning step and can impart a fluorescent property to substantially all of the particles if an aqueous layer coats the surface of the particles. Exemplary fluoressent dyes which can be used include fluoranthene Fluorescent Yellow G (a product of Morton Norwich Chemical Co.), rhodamine B, flavine FF, uranine and the like. Preferably, the fluorescent dye is combined with the surface-active agent prior to conditioning the ore by either mixing the fluorescent dye directly with the surface-active agent or by mixing the fluorescent dye with a suitable diluent or solvent, such as an oil, then mixing with the surface-active agent.

After conditioning the limestone particles with one of the above surface-active agents and fluorescent dyes, the particles are passed in free-fall past an irradiation source which irradiates the particles with a sufficient amount of radiation to excite and induce fluorescence of the fluorescent dye. Using the apparatus as shown in FIG. 1, an ore particle passing through the irradiation zone 16 is radiated and the fluorescence, if any, is detected in the detection zone 18 by the detector 17 which signals the control unit 19 which activates, depending upon the intensity of fluorescence, the first deflector 20, the second deflector 24 or neither deflector.

When a hydrophobic surface-active agent selective toward the calcium carbonate is used to coat the particles and when a hydrophobic fluorescent dye is combined with the hydrophobic surface-active agent, higher-grade limestone ore particles containing a relatively high concentration of calcium carbonate exhibit a relatively greater intensity of fluorescence than the particles containing a lesser concentration of calcium carbonate. This fraction of the limestone-containing ore particles can be separated from the mixture by the first deflector 20. This higher grade limestone ore in regard to calcium carbonate can be collected as a concentrate fraction.

A lower grade limestone-containing fraction can be separated by the apparatus by attenuating the control unit to distinguish among the intensities of fluorescence of the particles. Those particles fluorescing at a lower intensity than the intensity of those particles in the concentrate fraction can be separated from the free-falling particles by activating the second deflector 24. These particles exhibiting a relatively lower intensity of fluorescence contain a lower concentration of calcium carbonate and provide the middling fraction.

The particles which continue to fall in an undeflected path comprise the tailing fraction. The control unit 19 can be programmed to prevent the sending of a signal to the deflectors when a relatively low intensity of fluorescence or when substantially no fluorescence from a particle is detected. In this manner the fraction of particles containing substantially no calcium carbonate fall in an undeflected path and constitute the tailing fraction.

The process and apparatus herein provide an efficient means for separating a mixture of particles into three fractions with each fraction containing particles of similar composition with regard to a specific component in the mixture of particles. The process herein can be practiced in regard to any mixture of particles for which a surface-active agent can be selected. Typical mixtures of particles and surface-active agents that can be used to provide coatings on the particles are disclosed in United States patent application Ser. Nos. 897,779 filed Apr. 19, 1978, entitled SEPARATION OF COAL FROM WASTE MATERIAL now issued as U.S. Pat. Nos. 4,208,273; 897,947, filed Apr. 19, 1978, entitled METHOD OF SEPARATING A MIXTURE OF ORE PARTICLES now issued as U.S. Pat. Nos. 4,235,708; 897,778, filed Apr. 19, 1978, entitled APPARATUS AND METHOD FOR THE CONCENTRATION OF ORE now abandoned; 897,739, filed Apr. 19, 1978, entitled SEPARATION OF SHALE FROM WASTE MATERIAL, now issued as U.S. Pat. No. 4,169,045 dated Sept. 25, 1979; and 897,780, filed Apr. 19, 1978, entitled SEPARATION OF MAGNESITE FROM ORES WHICH ALSO CONTAIN CALCITE OR DOLOMITE, now issued as U.S. Pat. No. 4,207,175 dated June 10, 1980; all are assigned to the same assignee as this invention and all of the above applications are incorporated herein by this reference.

Convenient apparatus for conditioning a mixture of particles is disclosed in United States patent application Ser. No. 897,946, filed Apr. 19, 1978, entitled METHOD AND APPARATUS FOR SELECTIVE WETTING OF PARTICLES, now abandoned, and which application is assigned to the same assignee as this invention and is incorporated herein by this reference.

The following example illustrates the utility of the process in a separation of a coal into three fractions, each of similar composition.

EXAMPLE

A sample of coal identified as Loma No. 48 supplied by Sheridan Enterprises was crushed to a particle size greater than ¾ inch. The sample of coal was dipped into a conditioning mixture of a surface-active agent and fluorescent dye for a time of about 30 seconds. The conditioning mixture comprised a one percent by weight decyl alcohol aqueous solution with two percent by weight German Fluoranthene fluorescent dye.

Following conditioning of the coal about ten kilograms of the conditioned coal are fed into apparatus for separating the particles into three fractions of similar composition, as illustrated by FIGS. 1 and 2. The apparatus has an irradiation source sufficient to excite and induce fluorescence of the fluoranthene fluorescent dye. The conditioned particles fall through an irradiation zone whereupon the fluoranthene dye coating on some of the particles fluoresces. The falling conditioned particles are first scanned by a first fluorescence detector which sends a signal of the monitored intensity of fluorescence on each particle to a first control unit. The first control unit is provided with delay logic and a threshhold intensity triggering program such that the first control unit transmits an activating signal to a deflector when the intensity of fluorescence is greater than such threshhold level for a particle. The signal is timed such that the deflector provides a water stream under a pressure of about 80 psi which strikes the particle and diverts its falling path. The coal particles so deflected are collected as a concentrate fraction (higher-grade coal).

The conditioned particles fall through the irradiation zone and are irradiated with actinic radiation to induce fluorescence, the intensity of the fluorescence is monitored by a second detector which signals a second control unit. The second control unit is programmed with delay logic and a threshhold intensity setting different from and lower than the threshhold intensity setting for the first control unit. The second control unit sends an activating signal to a deflector when a signal of an intensity greater than the threshhold intensity is received from the second detector. The deflector upon receiving the activating signal emits a water stream of about 80 psi pressure which strikes the particle that initiated the sequence diverting the falling path of the particle. The particles so diverted are collected as a middling fraction (coal of a lower grade than previously separated higher-grade coal).

The conditioned coal particles not deflected fall substantially in a free-fall path through the apparatus and are collected as a tailing fraction. Such particles do not exhibit fluorescence to any substantial amount or do not fluoresce. The particles so collected can be a "boney coal," roof rock and slate. The term "boney coal" is used herein to refer to a relative distinction among coal particles based upon the high ash content in the coal particles, the coal particles with the inherently high ash content are referred to as "boney coal."

The results of a separation conducted as essentially described above are given in the following table. The term "concentrate" is used to refer to the higher-grade coal collected; the term "middling" is used to refer to the lesser-grade coal collected; and the term "tailing" is used to refer to the particles collected that fell in a substantially undiverted free-fall path. The results listed in the table show that a separation into three fractions each of similar composition was effected.

| | Weight | ASSAYS | | | | CONTENT | | | | PERCENT DISTRIBUTION | | | |
|---|---|---|---|---|---|---|---|---|---|---|---|---|---|
| Stream | Percent | % Ash | % S | % $H_2O$ | BTU/lb | Ash | S | $H_2O$ | BTU | Ash | S | $H_2O$ | BTU |
| Concentrate | 39.4 | 11.93 | 0.49 | 6.19 | 11541 | 470.00 | 19.31 | 243.87 | 454715 | 15.3 | 45.1 | 48.6 | 52.6 |
| Middling | 18.8 | 18.57 | 0.45 | 5.35 | 10575 | 349.12 | 8.46 | 100.58 | 198810 | 11.4 | 19.8 | 20.1 | 23.0 |
| Concentrate and Middling | 58.2 | 14.07 | 0.48 | 5.91 | 11229 | 819.12 | 27.77 | 344.45 | 653525 | 26.7 | 64.9 | 68.7 | 75.6 |
| Tailing | 41.8 | 53.83 | 0.36 | 3.75 | 5044 | 2250.09 | 15.5 | 156.75 | 210839 | 73.3 | 35.1 | 31.3 | 24.4 |
| Calc Heads | 100 | 30.69 | 0.43 | 5.01 | 8643 | 3069.21 | 42.82 | 501.20 | 864364 | 100 | 100 | 100 | 100 |

What is claimed is:

1. In a process for the separation of higher-grade limestone from lower-grade limestone and the gangue present in particulate limestone ore by the steps of conditioning the particulate limestone ore with at least one surface-active agent selected from saturated and unsaturated carboxylic acids containing from about 4 to about 22 carbon atoms, said surface-active agent selectively coating the calcium carbonate in the limestone ore to the substantial exclusion of coating gangue in combination with providing at least one fluorescent dye to said surface-active agent, irradiating the conditioned particulate limestone ore to excite and induce fluorescence of the fluorescent dye and separating the ore particles into a first fraction of fluorescing coated higher-grade limestone particles and a second fraction of coated lower-grade limestone and non-fluorescing gangue particles, the improvement comprising the step of separating the limestone particles into three fractions each of similar concentration of calcium carbonate by distinguishing among the intensities of fluorescence of the provided fluorescent dye on the particles with a first fraction comprising particles exhibiting a relatively high intensity of fluorescence, a second fraction comprising particles exhibiting a relative intensity of fluorescence lower than particles in the first fraction and a third fraction comprising particles exhibiting a relative intensity of fluorescence lower than particles in the second fraction.

2. A process as recited in claim 1 wherein the particles are separated into three fractions while in free-fall by deflecting some of the free-fall particles into either of two deflected free-fall paths and by permitting some of the particles to free-fall in an undeflected path based upon the intensity of fluorescence of the particles.

3. In a process for the separation for higher-grade limestone from lower-grade limestone and the silicate-containing gangue present in particulate limestone ore by the steps of conditioning the particulate limestone ore with at least one surface-active agent selected from the group consisting of aliphatic amines containing from about 8 to about 22 carbon atoms and beta amines containing from about 7 to about 21 carbon atoms, said surface-active agent selectively coating the silicates in the particles to the substantial exclusion of coating the calcium carbonate in the particles, in combination with providing at least one fluorescent dye to said surface-active agent, irradiating the conditioned particulate limestone ore to excite and induce fluorescence of the fluorescent dye and separating the fluorescing coated silicate-containing particles from the substantially non-fluorescing calcium carbonate containing particles, the improvement comprising the step of separating the limestone ore particles into three fractions, each of similar concentration of calcium carbonate by distinguishing among the intensities of fluorescence of the provided fluorescent dye on the particles with a first fraction comprising particles exhibiting a relatively high intensity of fluorescence, a second fraction comprising particles exhibiting a relative intensity of fluorescence lower than particles in the first fraction and a third fraction comprising particles exhibiting a relative intensity of fluorescence lower than particles in the second fraction.

4. A process as recited in claim 3 wherein the particles are separated into three fractions while in free-fall by deflecting some of the free-falling particles into either of two deflected free-fall paths and by permitting some particles to free-fall in an undeflected path based upon the intensity of fluorescence of the particles.

* * * * *